US007284815B2

(12) United States Patent
Uejima et al.

(10) Patent No.: US 7,284,815 B2
(45) Date of Patent: Oct. 23, 2007

(54) INKJET RECORDING APPARATUS AND INK DETERMINATION METHOD

(75) Inventors: Atsushi Uejima, Kanagawa (JP); Tsutomu Takatsuka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 273 days.

(21) Appl. No.: 11/037,289

(22) Filed: Jan. 19, 2005

(65) Prior Publication Data

US 2005/0156984 A1 Jul. 21, 2005

(30) Foreign Application Priority Data

Jan. 21, 2004 (JP) ..... 2004-013245

(51) Int. Cl.
*B41J 29/393* (2006.01)
*B41J 2/21* (2006.01)

(52) U.S. Cl. ..... 347/19; 347/43

(58) Field of Classification Search ..... 347/19
See application file for complete search history.

(56) References Cited

U.S. PATENT DOCUMENTS 5,792,380 A 8/1998 Wen et al.
6,106,089 A 8/2000 Wen et al.
6,125,986 A 10/2000 Nagase
6,561,635 B1 5/2003 Wen
2004/0036733 A1* 2/2004 Kubota et al. ..... 347/19

FOREIGN PATENT DOCUMENTS

| | | | |
|---|---|---|---|
| JP | 5-240782 A | * | 9/1993 |
| JP | 5-240782 A | | 9/1993 |
| JP | 11-213201 A | | 8/1999 |
| JP | 2000-146696 A | | 5/2000 |
| JP | 2001-328273 A | | 11/2001 |
| JP | 2001328273 A | * | 11/2001 |
| JP | 2002-365222 A | | 12/2002 |
| JP | 2003-344267 A | | 12/2003 |
| JP | 2003344267 A | * | 12/2003 |
| JP | 2004-66743 A | | 3/2004 |

* cited by examiner

*Primary Examiner*—Matthew Luu
*Assistant Examiner*—Jannelle M. Lebrón
(74) *Attorney, Agent, or Firm*—Birch, Stewart, Kolasch & Birch, LLP

(57) ABSTRACT

The inkjet recording apparatus comprises: a light emitting device which illuminates filled ink with light; a measuring device which measures a spectral characteristic of one of the light transmitted through the filled ink and the light reflected by the filled ink; and a determining device which determines whether the filled ink is a specific ink according to the spectral characteristic measured by the measuring device.

12 Claims, 9 Drawing Sheets

INKJET RECORDING APPARATUS AND INK DETERMINATION METHOD

BACKGROUND OF THE INVENTION

1. Field of the Invention

The present invention relates to an inkjet recording apparatus and an ink determination method, and more specifically to a technique for preventing inks other than specific inks from being filled in ink cartridges.

2. Description of the Related Art

Japanese Patent Application Publication No. 2003-154734 discloses a printing apparatus capable of preventing inks other than specific inks from being filled in the ink cartridges. Each of the ink cartridges is provided with a memory in which usage information for the ink cartridge is recorded, so that it can be determined whether the ink filled in the cartridge is the specific ink or not according to the usage information. However, this configuration requires the memory installed in every ink cartridge, and it is undesirable because of increased costs.

Japanese Patent Application Publication No. 11-35863 discloses ink compositions for inkjet recording. The ink composition contains a label material such as a magnetic field generating material and a magnetizable material, so that the type of the ink composition can be determined from the label material. However, the ink contains the label material that is unnecessary for the essential functions of the ink, and it is undesirable because of increased costs and also from an ecological standpoint. Although the compositions for distinguishing inks are described in detail in the publication, the determination method is only described that the detection of the label material can be readily made with a common sensor. In particular, optically determining the infrared concentration with an inexpensive commercial sensor leads to problems with precision and stability, and there is a high probability of erroneous determination. In order to stably determine the spectra, it is required to use a monochromator having an expensive grating optical system or the like.

Using an ink other than a specific predetermined ink in the inkjet recording apparatus leads to problems with reduced image quality and reduced durability in the head and other hardware, and it is hence disadvantageous for the users.

SUMMARY OF THE INVENTION

The present invention has been made in view of the foregoing circumstances, and it is an object of the invention to provide an inkjet recording apparatus and an ink determination method which make it possible to simply determine whether the ink used is a specific ink or not with high precision without requiring special ingenuities for the ink cartridge or the ink itself, and hence can prevent inks other than the specific inks from being filled.

In order to attain the aforementioned object, the present invention is directed to an inkjet recording apparatus, comprising: a light emitting device which illuminates filled ink with light; a measuring device which measures a spectral characteristic of one of the light transmitted through the filled ink and the light reflected by the filled ink; and a determining device which determines whether the filled ink is a specific ink according to the spectral characteristic measured by the measuring device.

According to the present invention, it is considered that every ink has a spectral characteristic unique to the type of the ink, and the inkjet recording apparatus is designed so as to determine whether the filled ink is the specific ink or not by measuring the spectral characteristic of the ink used.

In order to attain the aforementioned object, the present invention is also directed to an inkjet recording apparatus, comprising: a light emitting device which illuminates filled ink with light; a luminous energy measuring device which measures luminous energy of one of the light transmitted through the filled ink and the light reflected by the filled ink, the luminous energy measuring device measuring the luminous energy of the light in a plurality of different wavelengths for the filled ink of one color; and a determining device which determines whether the filled ink is a specific ink according to the luminous energy of the light in the plurality of different wavelengths measured by the luminous energy measuring device.

According to the present invention, the luminous energy of the light transmitted through the filled ink or reflected by the filled ink is measured in the different wavelengths for the one ink. It is then determined whether the filled ink is the specific ink or not according to the luminous energy of the light measured in the plurality of wavelengths by the luminous energy measuring device.

Thus, no special device is needed for the ink cartridge or the like, and consumable ink and cartridges can be made inexpensive. In addition, there is no need for a monochromator that requires an expensive lens, grating, or the like; an inexpensive light emitting device can be utilized; and an inexpensive apparatus can be provided.

Preferably, the light emitting device comprises a plurality of types of light emitting diodes with different luminescence peak wavelengths. By utilizing light emitting diodes as the light emitting device, it is inexpensively possible to emit light in a single wavelength and to easily control the luminous energy of the emitted light.

Preferably, the luminous energy measuring device comprises: one of a plurality of light sensors and a plurality of split detectors which measure the luminous energy of the one of the light transmitted through the filled ink and the light reflected by the filled ink, and luminous energy of the light received directly from the light emitting device; and a control device which controls the light emitting device so as to substantially keep the measured luminous energy of the light received directly from the light emitting device at a standard value.

Alternatively, the luminous energy measuring device comprises one of a plurality of light sensors and a plurality of split detectors which measure the luminous energy of the one of the light transmitted through the filled ink and the light reflected by the filled ink, and luminous energy of the light received directly from the light emitting device; and the luminous energy measuring device normalizes the measured luminous energy of the one of the light transmitted through the filled ink and the light reflected by the filled ink according to the measured luminous energy of the light received directly from the light emitting device.

According to the present invention, the luminous energy can be measured with high precision without being affected by time variation of the light emitting device and the luminous energy measuring device.

Preferably, the determining device determines whether the filled ink is the specific ink, by comparing one of a ratio and a difference of the luminous energy of the light in different wavelengths for the one color of the ink measured by the luminous energy measuring device with one of a ratio and a difference of luminous energy of the light measured in advance for the specific ink. According to this, it is possible to identify the ink with high precision without being affected by the absolute concentration of the ink.

Preferably, the inkjet recording apparatus further comprises a warning device which issues a warning when the determining device determines that the filled ink is different from the specific ink. According to this, the user can confirm that the filled ink is not the specific ink.

Preferably, the inkjet recording apparatus further comprises a print halt device which halts a printing operation in the inkjet recording apparatus when the determining device determines that the filled ink is different from the specific ink. According to this, the ink other than the specific ink can be prevented from being filled in the ink cartridge.

The present invention is also directed to an ink determination method, comprising the steps of: illuminating filled ink with light; measuring luminous energy of one of the light transmitted through the filled ink and the light reflected by the filled ink, in a plurality of different wavelengths for the filled ink of one color; and determining whether the filled ink is a specific ink according to the luminous energy of the light measured in the measuring step.

According to the present invention, since a spectral characteristic unique to the type of ink is measured to determine the type of ink used, it is possible to simply determine with high precision whether the ink used is a specific ink or not without applying special treatment to the ink cartridge or the ink itself. It is thereby possible to prevent an ink other than the specific ink from being filled.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
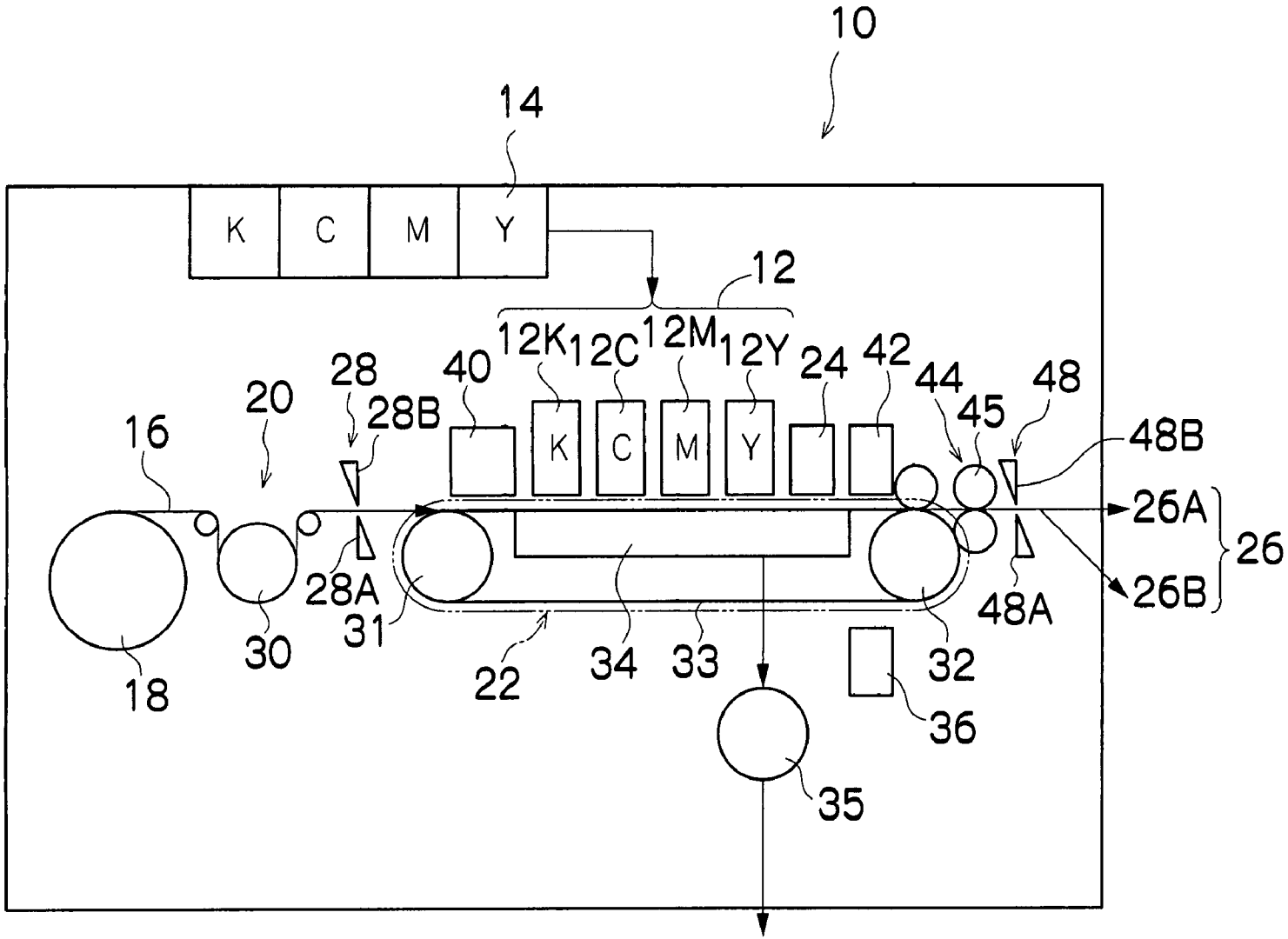
FIG. 1 is a general schematic drawing of an inkjet recording apparatus according to an embodiment of the present invention.

FIG. 1 is a general schematic drawing of an inkjet recording apparatus according to an embodiment of the present invention. As shown in FIG. 1, the inkjet recording apparatus 10 comprises: a printing unit 12 having a plurality of inkjet heads (hereinafter referred to as "heads") 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1 and the continuous paper is cut into a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 forms a so-called full-line head in which a line head having a length that corresponds to the maximum paper width is disposed in the main scanning direction perpendicular to the delivering direction of the recording paper 16, which is substantially perpendicular to a width direction of the recording paper 16. Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10.

The print heads 12K, 12C, 12M, and 12Y are arranged in the order of black (K), cyan (C), magenta (M), and yellow (Y) from the upstream side along the delivering direction of the recording paper 16 (hereinafter referred as the paper conveyance direction). A color print can be formed on the recording paper 16 by ejecting the inks from the print heads 12K, 12C, 12M, and 12Y, respectively, onto the recording paper 16 while conveying the recording paper 16.

The print determination unit 24 has a line sensor for capturing an image of the ink-droplet deposition result of the print unit 12, and functions as a device to check for ejection defects such as clogs of the nozzles in the print unit 12 from the ink-droplet deposition results evaluated by the line sensor.

The post-drying unit 42 is disposed following the print determination unit 24. The post-drying unit 42 is a device to dry the printed image surface, and includes a heating fan, for example. It is preferable to avoid contact with the printed surface until the printed ink dries, and a device which blows heated air onto the printed surface is preferable.

The heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in FIG. 1, the paper output unit 26A for the target prints is provided with a sorter for collecting prints according to print orders.

Next, the configuration of the ink supply system in the inkjet recording apparatus 10 is described.

Figure 2:
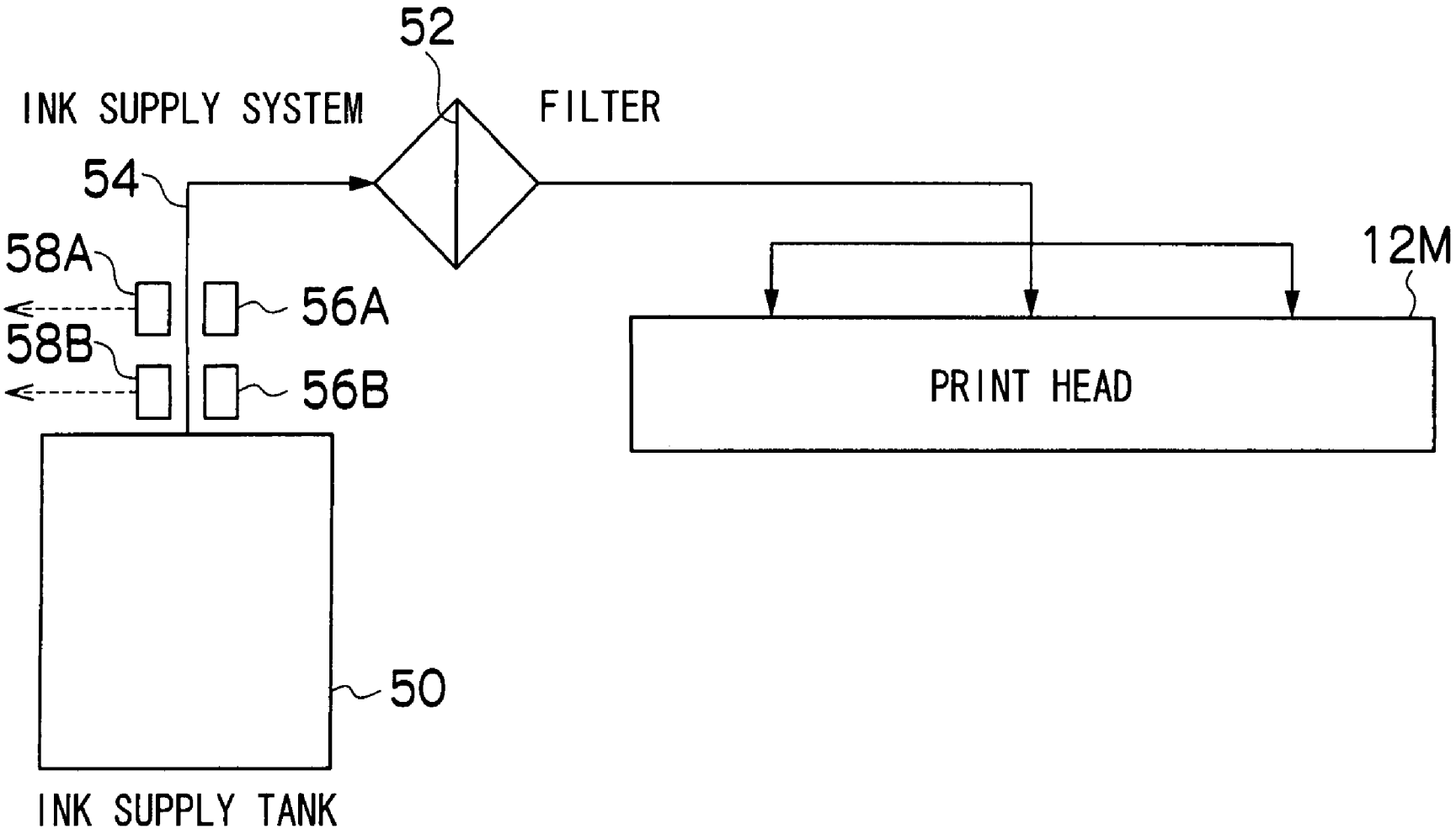
FIG. 2 is a schematic drawing showing the configuration of the ink supply system in the inkjet recording apparatus.

FIG. 2 is a schematic drawing showing the configuration of the ink supply system in the inkjet recording apparatus 10. The print heads 12K, 12C, 12M and 12Y have the same structure, and the ink supply system according to a single ink (magenta in this example) is hereinafter explained. An ink supply tank 50 is a base tank that supplies ink and is set in the ink storing and loading unit 14 described with reference to FIG. 1. The aspects of the ink supply tank 50 include a refillable type and a cartridge type: when the remaining amount of ink is low, the ink supply tank 50 of the refillable type is filled with ink through a filling port (not shown) and the ink supply tank 50 of the cartridge type is replaced with a new one. In order to change the ink type in accordance with the intended application, the cartridge type is suitable.

A filter 52 for removing foreign matters and bubbles is disposed between the ink supply tank 50 and the print head 12M. The filter mesh size in the filter 52 is preferably equivalent to or less than the diameter of the nozzle and commonly about 20 μm.

Light emitting diodes (LEDs) 56A and 56B and photodiodes 58A and 58B are arranged so as to respectively face each other across a conduit line 54 between the ink supply tank 50 and the filter 52. A part of the conduit line 54 facing the LEDs 56A and 56B and the photodiodes 58A and 58B or all of the conduit line 54 is made of a transparent material.

The LEDs 56A and 56B emit illuminational light with different wavelengths, and the photodiodes 58A and 58B receive the illuminational light emitted from the LEDs 56A and 56B and transmitted through the ink in the conduit line 54, respectively. Each of the photodiodes 58A and 58B measures the transmitted luminous energy of the received illuminational light in each of the different wavelengths, and accordingly outputs a measurement signal representing the measured luminous energy to a print controller. The print controller determines whether the ink used is a specific ink or not according to two measurement signals inputted from the photodiodes 58A and 58B. These procedures are described after in detail.

Figure 3:
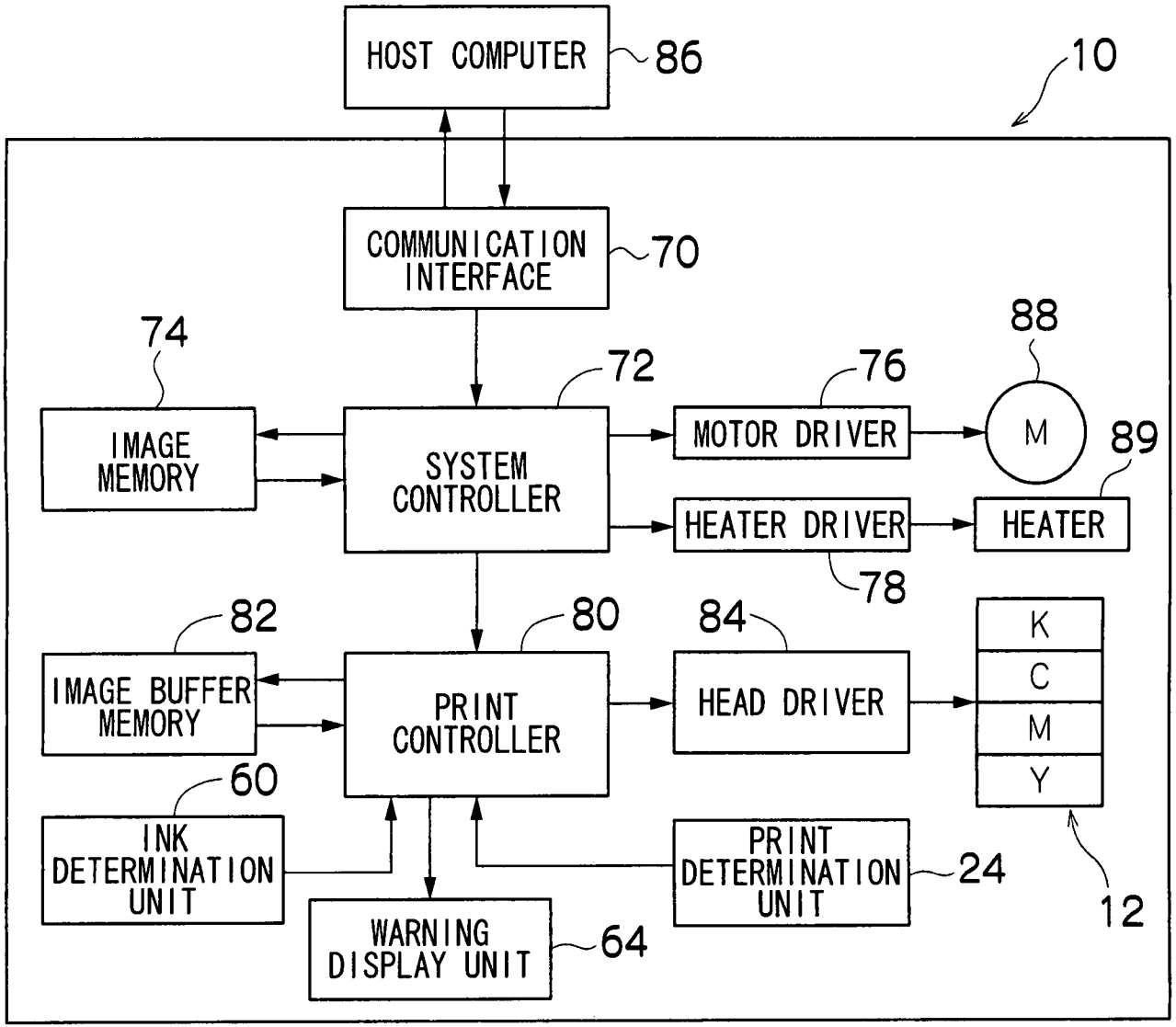
FIG. 3 is a block diagram of the principal components showing the system configuration of the inkjet recording apparatus.

FIG. 3 is a block diagram of the principal components showing the system configuration of the inkjet recording apparatus 10. The inkjet recording apparatus 10 has a communication interface 70, a system controller 72, an image memory 74, a motor driver 76, a heater driver 78, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of a semiconductor element, and a hard disk drive or another magnetic medium may be used.

The system controller 72 controls the communication interface 70, image memory 74, motor driver 76, heater driver 78, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling a motor 88 and a heater 89 in the conveyance system.

The motor driver (drive circuit) 76 drives the motor 88 in accordance with commands from the system controller 72.

The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (image formation data) to the head driver 84.

The print control unit 80 is a control unit having a signal processing function for performing various treatment processes, corrections, and the like, in accordance with the control implemented by the system controller 72, in order to generate a signal for controlling printing, from the image data in the image memory 74, and it supplies the print control signal (image data) thus generated to the head driver 84. Prescribed signal processing is carried out in the print control unit 80, and the discharge amount and the discharge timing of the ink droplets or the protective liquid from the respective print heads 50 are controlled via the head drier 84, on the basis of the image data. By this means, prescribed dot size, dot positions, or coating of protective liquid can be achieved.

The print controller 80 is provided with the image buffer memory 82; and image data, parameters, and other data are temporarily stored in the image buffer memory 82 when image data is processed in the print controller 80. The aspect shown in FIG. 3 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the actuators for the print heads 12K, 12C, 12M and 12Y of the respective colors on the basis of the print data received from the print controller 80. A feedback control system for keeping the drive conditions for the print heads constant may be included in the head driver 84.

The print determination unit 24 is a block that includes the line sensor as described above with reference to FIG. 1, reads the image printed on the recording paper 16, determines the print conditions (presence of the ejection, variation in the dot deposition, and the like) by performing desired signal processing, or the like, and provides the determination results of the print conditions to the print controller 80. The print controller 80 makes various compensation with respect to the print head 12 as required on the basis of the information obtained from the print determination unit 24.

An ink determination unit 60 outputs, to the print controller 80, measurement signals representing the transmitted luminous energy of the light with specific wavelengths transmitted through the inks of colors K, C, M, and Y The print controller 80 determines whether each ink used is a specific ink or not according to the measurement signal inputted from the ink determination unit 60. If it is determined that the ink used is different from the specific ink, the print controller 80 displays the determined information on a warning display unit 64 and/or causes a sound generating unit (not shown) to generate an alarm sound, and also functions as a control unit for informing the system controller 72 that the ink used is different from the specific ink so as to halt the printing operation.

Figure 4:
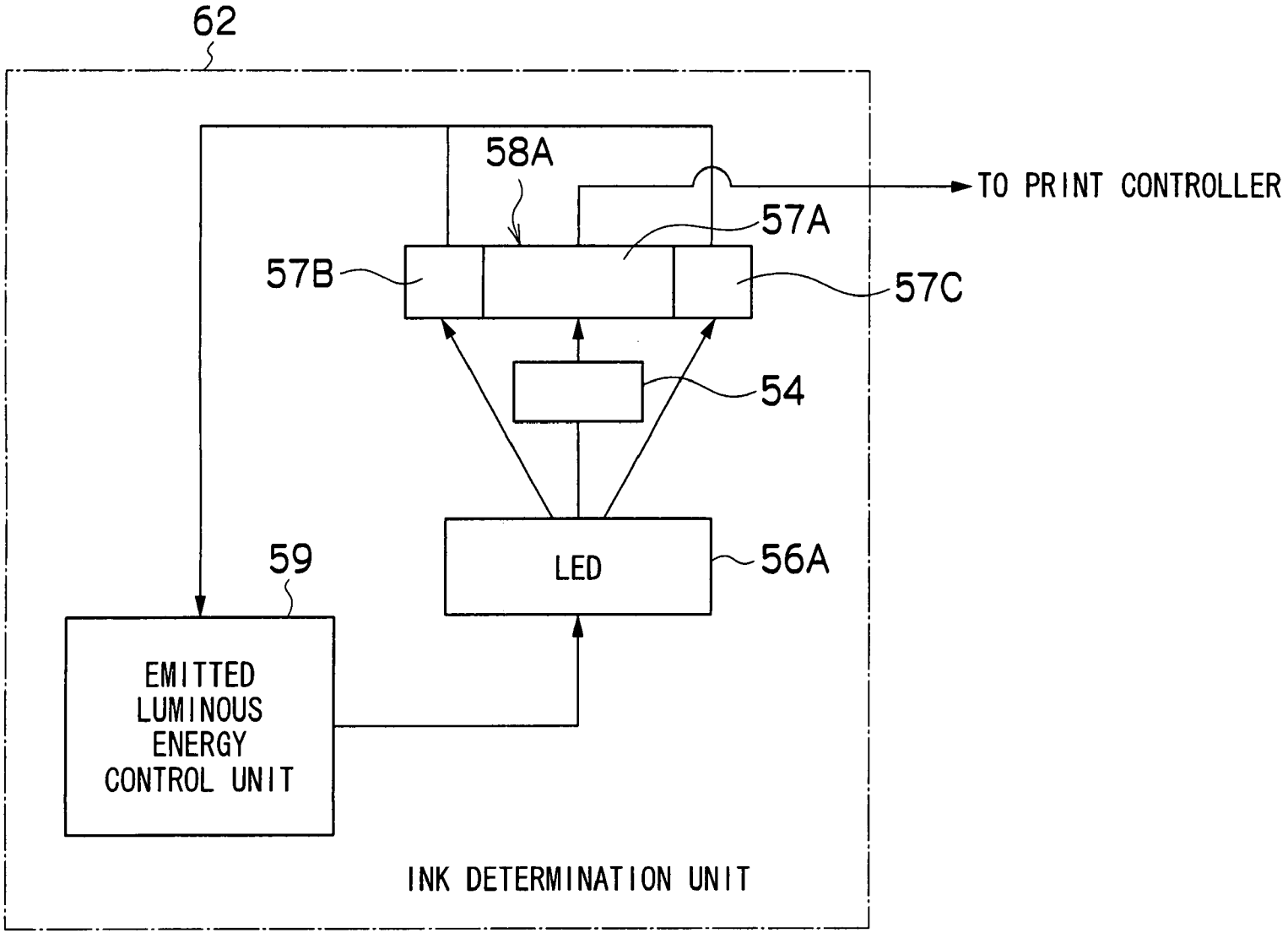
FIG. 4 is a diagram showing the details of an ink determination unit including an LED and a photodiode.

Next, the ink determination unit 60 is described in detail. As shown in FIG. 2, the LEDs 56A and 56B and the photodiodes 58A and 58B are arranged across the conduit line 54 for one color of ink (magenta in the example in FIG. 2). FIG. 4 shows an ink determination unit 62, which is a part of the ink determination unit 60 and includes the LED 56A and the photodiode 58A.

The LED 56A emits illuminational light with an emission peak at wavelength $\lambda_1$ (e.g., 550 nm), toward the conduit line 54 and the like.

The photodiode 58A is a three-way split photodiode having three photodetectors 57A, 57B, and 57C. The photodetector 57A receives the light transmitted through the conduit line 54, and outputs a measurement signal representing the luminous energy of the received light to the print controller 80. Each of the photodetectors 57B and 57C receives the light directly from the LED 56A, and outputs a measurement signal representing the luminous energy of the received light to an emitted luminous energy control unit 59.

The emitted luminous energy control unit 59 compares preset standard luminous energy with the luminous energy represented by the measurement signals inputted from the photodetectors 57B and 57C, and adjusts the luminous energy of the light emitted by the LED 56A so that the luminous energy represented by the measurement signals is equal to the preset standard luminous energy.

Figure 5:
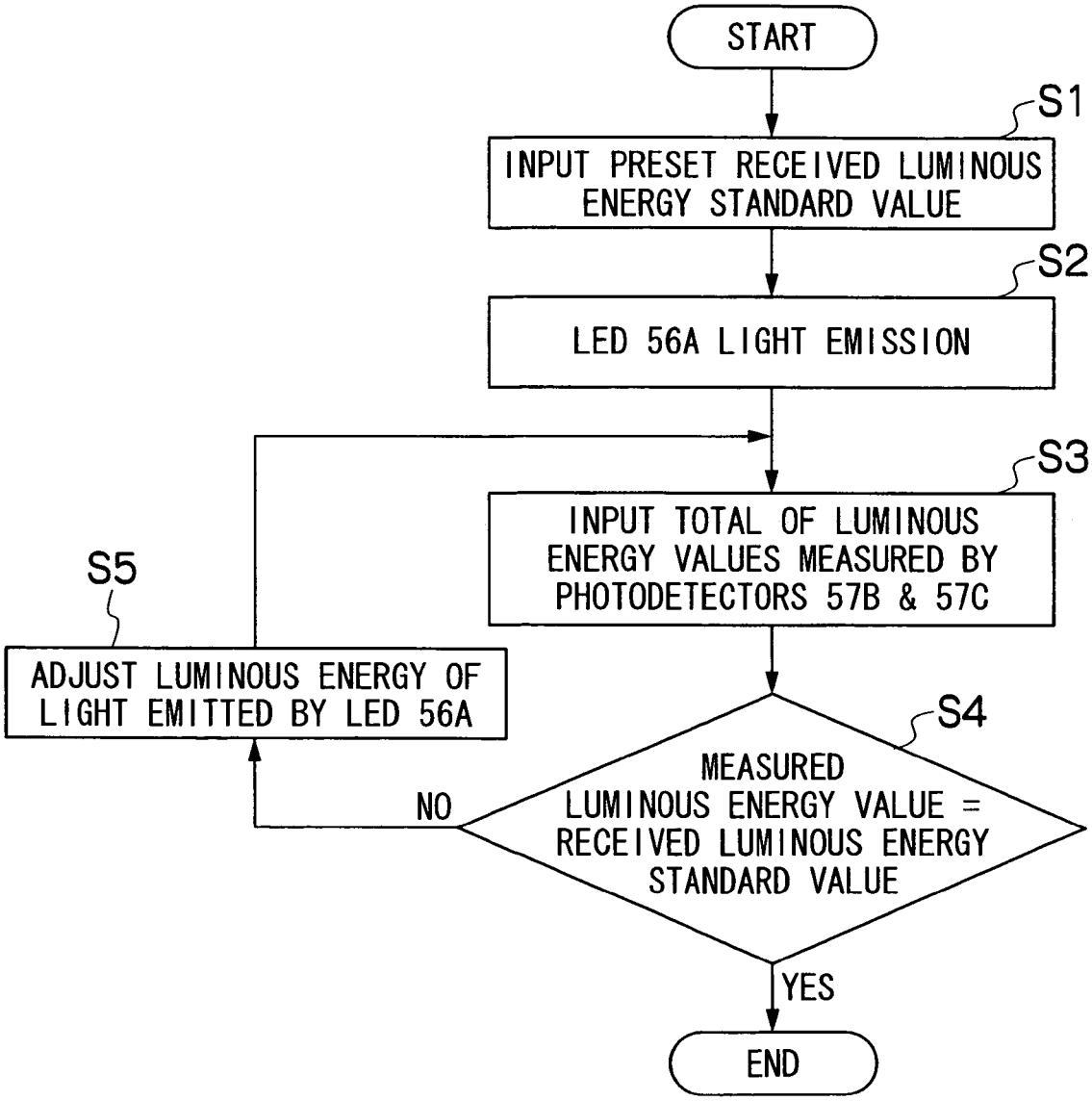
FIG. 5 is a flowchart showing the operation of an emitted luminous energy control unit that controls the luminous energy of the light emitted by the LED.

FIG. 5 is a flowchart showing the luminous energy adjusting operation of the emitted luminous energy control unit 59. The emitted luminous energy control unit 59 reads a preset received luminous energy standard value (step S1) prior to the ink determination, and causes the LED 56A to emit light (step S2). Then, the emitted luminous energy control unit 59 reads the total of the luminous energy values measured by the photodetectors 57B and 57C of the photodiode 58A accordingly to the light emission of the LED 56A (step S3), and determines whether the measured luminous energy is equal to the standard luminous energy of the received light or not (step S4).

When the emitted luminous energy control unit 59 determines that the measured luminous energy is not equal to the received luminous energy standard value, the emitted luminous energy control unit 59 adjusts the luminous energy of the light emitted by the LED 56A (step S5), and the process returns to the step S3. The adjustment of the luminous energy of the light emitted by the LED 56A at the step S5 is, for example, performed so that the electric current supplied to the LED 56A increases when the measured luminous energy is less than the received luminous energy standard value (the measured luminous energy<the received luminous energy standard value), or the electric current supplied to the LED 56A decreases when the measured luminous energy is greater than the received luminous energy standard value (the measured luminous energy>the received luminous energy standard value). When the measured luminous energy is equal to the received luminous energy standard value in the procedure at the steps S3 through S5, the luminous energy adjusting operation ends. The luminous energy adjusting operation is not limited to being performed prior to the ink determination, and may also be continuously performed during the ink determination.

The luminous energy adjusting operation thus prevents the measurement signal obtained by the photodetector 57A in the ink determination from being affected by time variation of the light emitted by the LED 56A, the ambient temperature, and other properties.

The photodiode 58A is not limited to a three-way split photodiode, and may be a two-way split photodiode or may include a plurality of photodiodes. Moreover, the conduit line 54 for supplying the magenta ink is provided with another ink determination unit including the LED 56B and the photodiode 58B shown in FIG. 2. This ink determination unit is similar to the ink determination unit 62 shown in FIG. 4, and differs from the ink determination unit 62 in that the emission peak wavelength $\lambda_2$ (e.g., 600 nm) of the light emitted by the LED 56B is different from the emission peak wavelength $\lambda_1$ of the light emitted by the LED 56A. Furthermore, each of the conduit lines supplying the inks of other colors (K, C, and Y) other than the conduit line 54 supplying the magenta ink is also provided with two ink determination units similar to the above-described ink determination units.

In the embodiment described with reference to FIG. 4, the emitted luminous energy control unit 59 adjusts the luminous energy emitted by the LED 56A so that the photodetectors 57B and 57C can receive the standardized luminous energy; however, the configuration is not limited thereto. Instead of the emitted luminous energy control unit 59, the ink determination unit may be provided with a luminous energy measuring device that divides the value based on the measurement signal obtained from the photodetector 57A by the value based on the measurement signals obtained from the photodetectors 57B and 57C, and thereby outputs a measurement signal that is normalized through this division.

Figure 6:
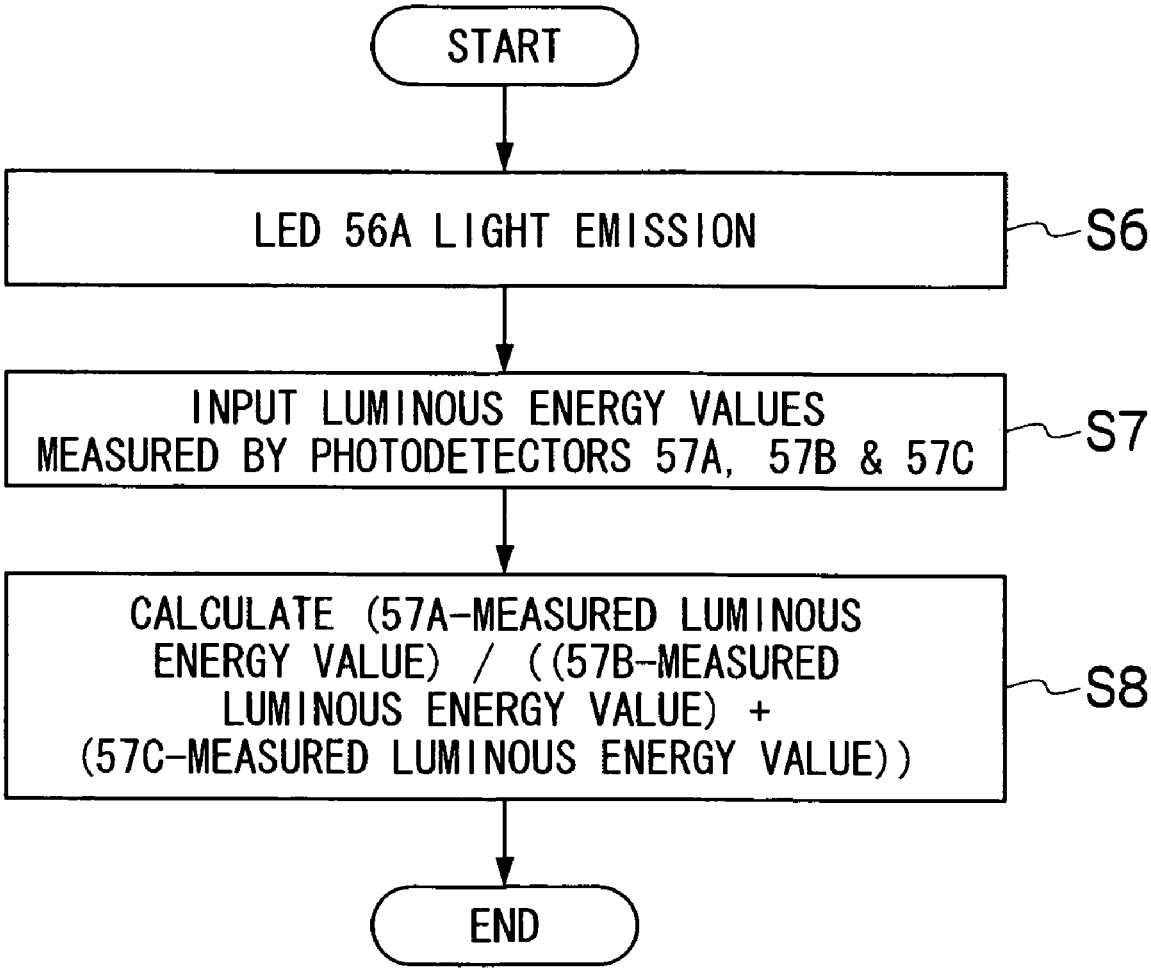
FIG. 6 is a flowchart showing the process and operation of a luminous energy measuring device which obtains a normalized measurement signal.

FIG. 6 is a flowchart showing the process and operation of the luminous energy measuring device for obtaining the normalized measurement signal. This luminous energy measuring device causes the LED 56A to emit light (step S6), and receives luminous energy values measured by the three photodetectors 57A, 57B, and 57C of the photodiode 58A accordingly to the light emitted by the LED 56A (step S7).

The luminous energy measuring device then divides the luminous energy value measured by the photodetector 57A onto which the light enters through the conduit line 54, by the total of the luminous energy values measured by the photodetectors 57B and 57C onto which the light enters directly from the LED 56A. The luminous energy measuring device then outputs the division result as a normalized measurement signal (step S8). Thus, as is the case with the ink determination unit 62, it is possible to obtain the measurement signal without being affected by time variation of the light emitted by the LED 56A, the ambient temperature, and other properties.

Next, the method for determining whether the ink used in the inkjet recording apparatus 10 is a specific ink or not is described with reference to FIG. 7.

Figure 7:
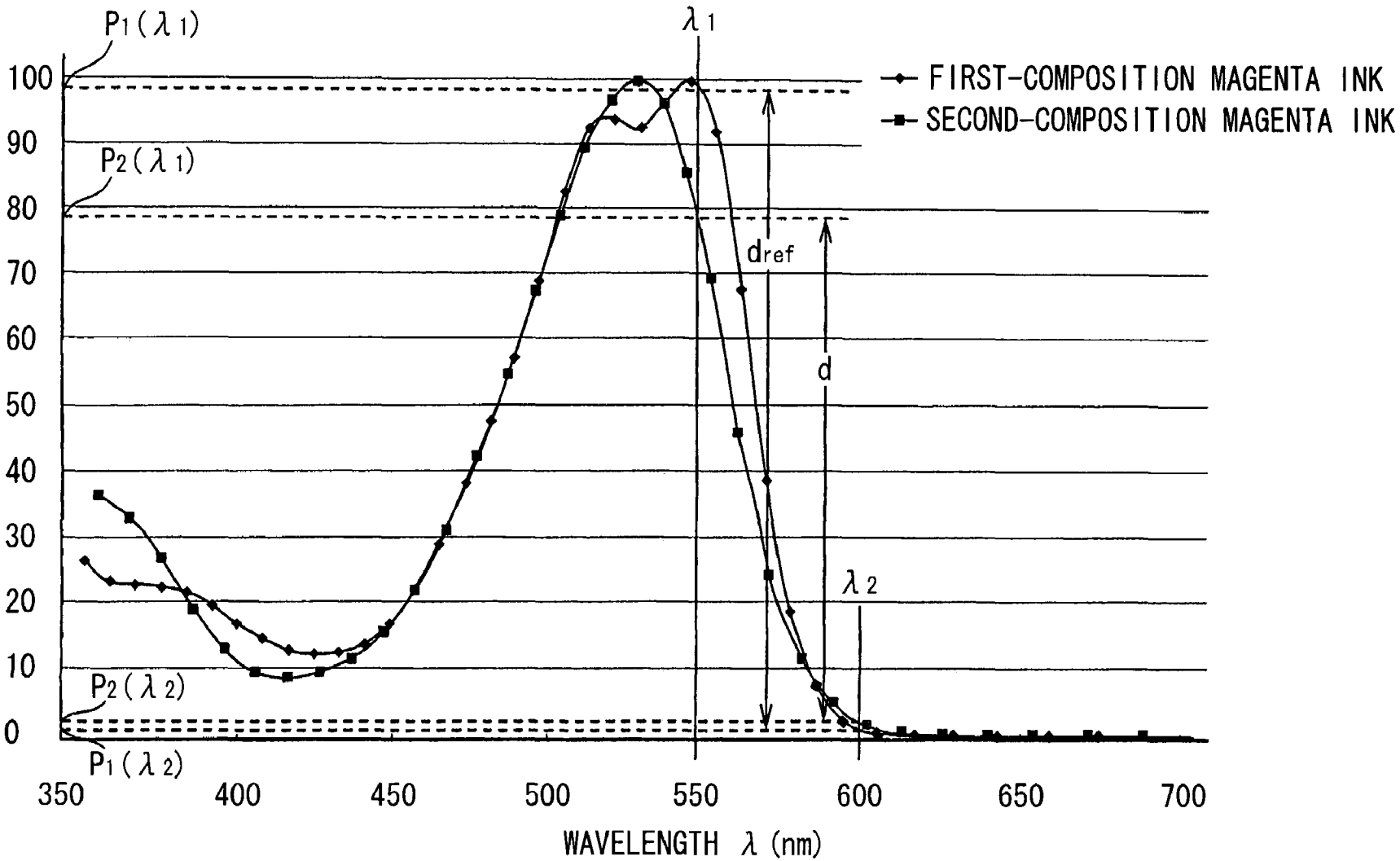
FIG. 7 is a graph showing the spectral characteristics of a first-composition magenta ink and a second-composition magenta ink.

FIG. 7 is a graph showing the spectral characteristics of a first-composition magenta ink and a second-composition magenta ink, where the spectral characteristics are normalized with the peak values of the spectral intensity for the inks. As shown in FIG. 7, the spectral characteristics of the first-composition magenta ink are different from the spectral characteristics of the second-composition magenta ink; for example, the spectral intensity at the wavelength $\lambda_1$ of 550 nm for the second-composition magenta ink is about 20% less than the spectral intensity at the wavelength $\lambda_1$ of 550 nm for the first-composition magenta ink.

Although it is possible for a third party to prepare an ink with the same spectral intensity at a single wavelength with the specific ink, it is difficult for the third party to prepare an ink with the same spectral intensity at each of a plurality of wavelengths with the specific ink.

Hence, when the first-composition magenta ink is used as the specific ink, whether the second-composition magenta ink is the specific ink or not is determinable according to the degree of correspondency between the spectral intensities of the first-composition magenta ink and the spectral intensities of the second-composition magenta ink at a plurality of wavelengths (in this embodiment, the wavelength $\lambda_1$ of 550 nm and the wavelength $\lambda_2$ of 660 nm).

More specifically, the ratio between the spectral intensities $P_1(\lambda_1)$ and $P_2(\lambda_2)$ at the wavelengths $\lambda_1$ and $\lambda_2$ for the first-composition magenta ink is set as a reference ratio $R_{ref}$ (i.e., $R_{ref}=P_1(\lambda_1)/P_1(\lambda_2)$). Whether the second-composition magenta ink is the specific ink or not is determined according to whether a ratio R between the spectral intensities $P_2(\lambda_1)$ and $P_2(\lambda_2)$ at the wavelengths $\lambda_1$ and $\lambda_2$ for the second-composition magenta ink (i.e., $R=P_2(\lambda_1)/P_2(\lambda_2)$) substantially corresponds to the reference ratio $R_{ref}$ or not.

As another embodiment, it is also possible for determining the degree of correspondency between the spectral intensities of the first-composition magenta ink and the spectral intensities of the second-composition magenta ink, that the difference between the spectral intensities $P_1(\lambda_1)$ and $P_1(\lambda_2)$ at the wavelengths $\lambda_1$ and $\lambda_2$ for the first-composi magenta ink is set as a reference difference $d_{ref}$ (i.e., $d_{ref}=P_1(\lambda_1)-P_1(\lambda_2)$). Whether the second-composition magenta ink is the specific ink or not is determined according to whether a difference d between the spectral intensities $P_2(\lambda_1)$ and $P_2(\lambda_2)$ at the wavelengths $\lambda_1$ and $\lambda_2$for the second-composition magenta ink (i.e., $d=P_2(\lambda_1)-P_2(\lambda_2)$) substantially corresponds to the reference difference $d_{ref}$ or not.

Next, the process of the print controller 80 for determining whether the ink used in the inkjet recording apparatus 10 is a predetermined specific ink or not is described with reference to FIG. 8. The following description is made with respect to a case where a magenta ink, for example, is determined to be a specific ink or not, and this determination procedure can be similarly applied to other types of inks.

Figure 8:
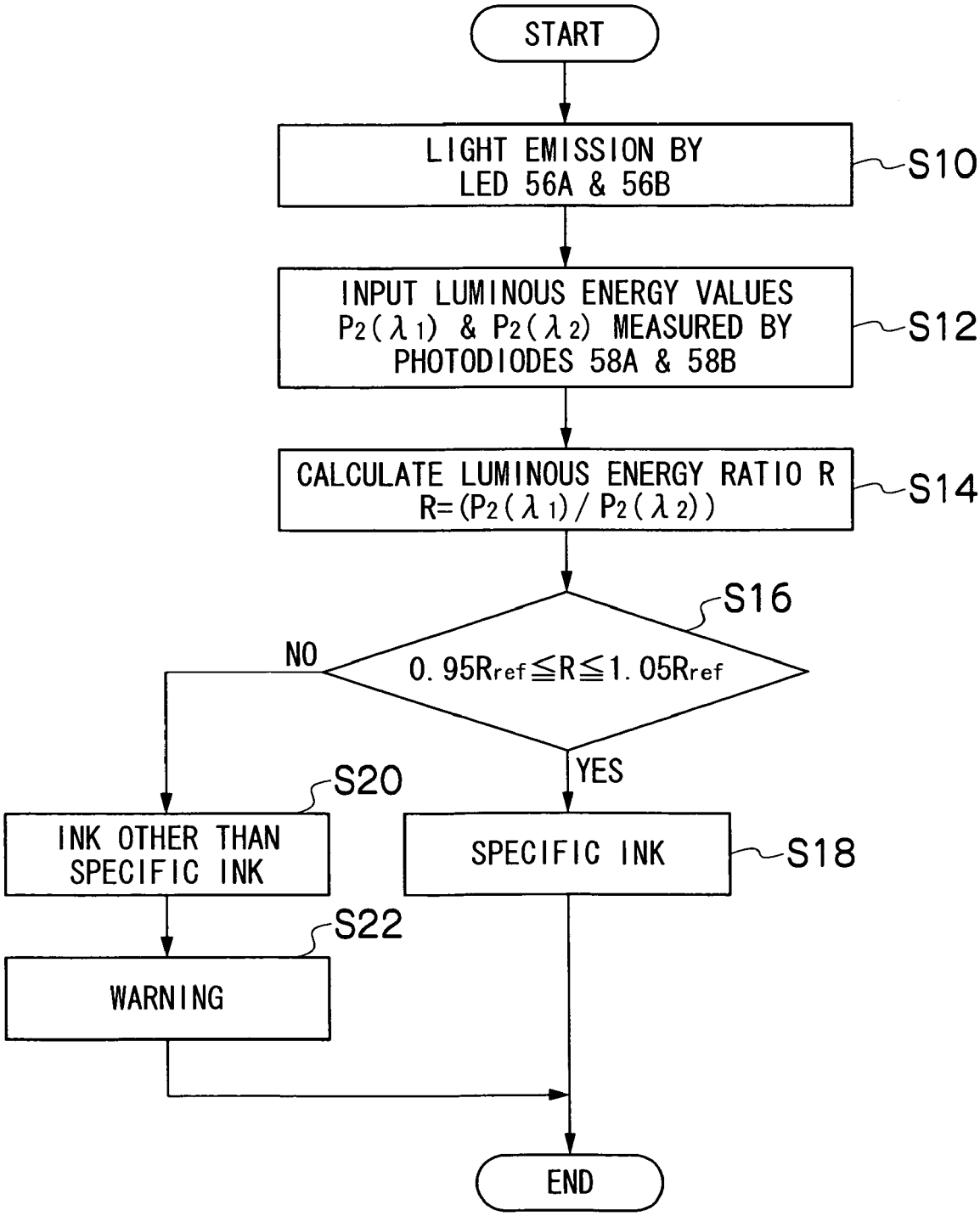
FIG. 8 is a flowchart showing an embodiment of the procedure in the determination process that determines whether the ink used in the inkjet recording apparatus is a specific ink or not.

In FIG. 8, the illuminational light with the emission peak at the wavelength $\lambda_1$ (550 nm) is emitted by the LED 56A, and the illuminational light with the emission peak at the wavelength $\lambda_2$ (600 nm) is emitted by the LED 56B (step S10). Signals representing the measured luminous energy (signals corresponding to the aforementioned spectral intensities $P_2(\lambda_1)$ and $P_2(\lambda_2)$) are inputted from the photodiodes 58A and 58B, which measure the luminous energy of the light transmitted through the magenta ink in the conduit line 54 (step S12).

Next, the ratio R of the measured luminous energy values ($R=P_2(\lambda_1)/P_2(\lambda_2)$) is calculated according to the inputted signals (step S14). It is then determined whether the ratio R varies by ±5% or greater in relation to the reference ratio $R_{ref}$ of the measured luminous energy values for the preset specific ink or not (i.e., whether $0.95\ R_{ref} \leqq R \leqq 1.05\ R_{ref}$ or not) (step S16).

If $0.95\ R_{ref} \leqq R \leqq 1.05\ R_{ref}$, then the ink currently being used is determined to be the specific ink (step S18), and the ink determination process is completed.

If the relationship $0.95\ R_{ref} \leqq R \leqq 1.05\ R_{ref}$ does not apply, then the current ink is determined to be an ink other than the specific ink (step S20), a warning display is shown on the warning display unit 64, and/or an alarm sound is generated by the sound generating unit (step S22).

Figure 9:
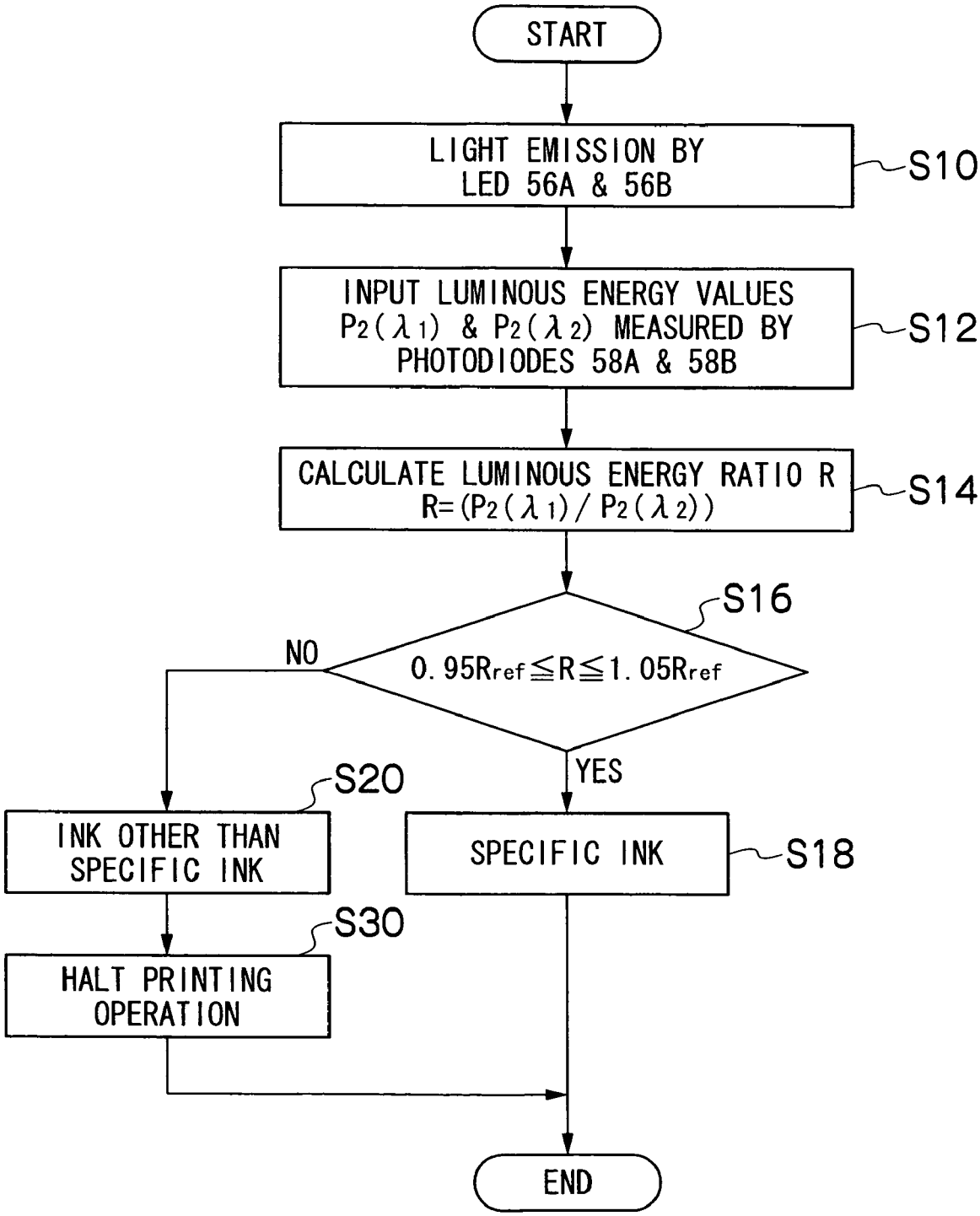
FIG. 9 is a flowchart showing another embodiment of the procedure in the determination process that determines whether the ink used in the inkjet recording apparatus is a specific ink or not.

FIG. 9 is a flowchart showing another embodiment of the process of the print controller 80 for determining whether the ink used in the inkjet recording apparatus 10 is a predetermined specific ink or not. The steps common to the embodiment shown in FIG. 8 are denoted by the same step numbers, and detailed descriptions thereof are omitted.

In the embodiment shown in FIG. 8, when it is determined that the current ink is different from the specific ink, a warning display is shown on the warning display unit 64 and/or an alarm sound is generated by the sound generating unit in the step S22. On the other hand, the embodiment shown in FIG. 9 differs from the embodiment shown in FIG. 8 in that a step S30 is arranged instead of the above-mentioned step S22. In the step S30, the printing operation of the inkjet recording apparatus 10 is halted. The procedure may be provided with both the step S30 for halting the printing operation and the step S22 for issuing the warning.

While the ink determination unit in the above-described embodiments is provided with the plurality of LEDs of the different emission peak wavelengths as the light emitting devices, the light emitting device is not limited thereto. For example, the ink determination unit may include a light emitting device other than the LED, and may include one light emitting device of which light emitting part is provided with a plurality of filters transmitting light with different wavelengths so that a plurality of types of the illuminational light with different emission peak wavelengths can be obtained from the one light emitting device.

Moreover, while the ink determination unit in the above-described embodiments is provided with the photodiodes as the luminous energy measuring device, the luminous energy measuring device is not limited thereto. Furthermore, the ink determination unit may include: a light emitting device that emits illuminational light of white or other colors; and a plurality of luminous energy measuring devices with different measurement sensitivities for light with different wavelengths transmitted through the ink.

Further, while the luminous energy transmitted through the ink in the conduit line between the ink supply tank and the filter is measured in the above-described embodiments, it is also possible to arrange a transparent window at an ink supply tank or to make an ink supply tank of a transparent material so that the luminous energy transmitted through the ink in the ink supply tank is measured.

Furthermore, the ink determination unit may be provided with a reflected luminous energy measuring device that measures the luminous energy reflected by the ink, instead of the transmitted luminous energy measuring device in the above-described embodiments that measures the luminous energy transmitted through the ink. Moreover, it is preferable to provide the ink determination unit with both the transmitted luminous energy measuring device and the reflected luminous energy measuring device. In this case, the output of the transmitted luminous energy measuring device and the output of the reflected luminous energy measuring device are combined through a differential amplifier, so that an amplified output signal is obtained and the signal to noise ratio (S/N) is improved.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a light emitting device which illuminates an inkjet recording ink with light, the inkjet recording ink being filled in at least one of an ink supply tank made at least partially of a transparent material, and a line provided between an ink supply tank and an inkjet head, the line being made at least partially of a transparent material;

a measuring device which measures a spectral characteristic of one of the light transmitted through the inkjet recording ink and the light reflected by the inkjet recording ink, the measuring device measuring, in a plurality of wavelengths, luminous energy of light transmitted through the inkjet recording ink and/or light reflected by the inkjet recording ink, for inkjet recording ink of one color; and a determining device which determines whether the inkjet recording ink is the specific ink according to the luminous energy in the plurality of wavelengths measured by the measuring device, and the spectral characteristic of the specific ink, the determining device being capable of determining at least whether the inkjet recording ink is an ink which has a color similar to the specific ink and has a composition different from a composition of the specific ink.

2. An inkjet recording apparatus, comprising:

a light emitting device which illuminates an inkjet recording ink with light, the inkjet recording ink being filled in at least one of an ink supply tank made at least partially of a transparent material, and a line between an ink supply tank and an inkjet head; a luminous energy measuring device which measures luminous energy of one of the light transmitted through the inkjet recording ink and the light reflected by the inkjet recording ink, the luminous energy measuring device measuring the luminous energy of the light in a plurality of different wavelengths for the inkjet recording ink of one color; and a determining device which obtains a ratio or difference of the luminous energy measured by the luminous energy measuring device in the plurality of different wavelengths, makes a comparison between the obtained ratio or difference of the luminous energy in the plurality of different wavelengths, and a ratio or difference of luminous energy, in the plurality of different wavelengths, for one of the light transmitted through an ink having a first composition, and light reflected by the ink having the first composition, and determines whether the inkjet recording ink is the ink having the first composition, or whether the inkjet recording ink has a color similar to the ink having the first composition and has a second composition different from the first composition, according to a result of the comparison.

3. The inkjet recording apparatus as defined in claim 2, wherein the light emitting device comprises a plurality of types of light emitting diodes with different luminescence peak wavelengths.

4. The inkjet recording apparatus as defined in claim 2, wherein the luminous energy measuring device comprises:

a plurality of light sensors which measure the luminous energy of the one of the light transmitted through the inkjet recording ink and the light reflected by the inkjet recording ink, and luminous energy of the light received directly from the light emitting device; and a control device which controls the light emitting device so as to substantially keep the measured luminous energy of the light received directly from the light emitting device at a standard value.

5. The inkjet recording apparatus as defined in claim 2, wherein the luminous energy measuring device comprises:

a plurality of split detectors which measure the luminous energy of the one of the light transmitted through the inkjet recording ink and the light reflected by the inkjet recording ink, and luminous energy of the light received directly from the light emitting device; and a control device which controls the light emitting device so as to substantially keep the measured luminous energy of the light received directly from the light emitting device at a standard value.

6. The inkjet recording apparatus as defined in claim 2, wherein:

the luminous energy measuring device comprises a plurality of light sensors which measure the luminous energy of the one of the light transmitted through the inkjet recording ink and the light reflected by the inkjet recording ink, and luminous energy of the light received directly from the light emitting device; and the luminous energy measuring device normalizes the measured luminous energy of the one of the light transmitted through the inkjet recording ink and the light reflected by the inkjet recording ink according to the measured luminous energy of the light received directly from the light emitting device.

7. The inkjet recording apparatus as defined in claim 2, wherein:

the luminous energy measuring device comprises a plurality of split detectors which measure the luminous energy of the one of the light transmitted through the inkjet recording ink and the light reflected by the inkjet recording ink, and luminous energy of the light received directly from the light emitting device; and the luminous energy measuring device normalizes the measured luminous energy of the one of the light transmitted through the inkjet recording ink and the light reflected by the inkjet recording ink according to the measured luminous energy of the light received directly from the light emitting device.

8. The inkjet recording apparatus as defined in claim 2, wherein the determining device determines whether the inkjet recording ink is the specific ink, by comparing a ratio of the luminous energy of the light in different wavelengths for the one color of the ink measured by the luminous energy measuring device with a ratio of luminous energy of the light in the different wavelengths measured in advance for the specific ink.

9. The inkjet recording apparatus as defined in claim 2, wherein the determining device determines whether the inkjet recording ink is the specific ink, by comparing a difference of the luminous energy of the light in different wavelengths for the one color of the ink measured by the luminous energy measuring device with a difference of luminous energy of the light in the different wavelengths measured in advance for the specific ink.

10. The inkjet recording apparatus as defined in claim 2, further comprising a warning device which issues a warning when the determining device determines that the inkjet recording ink is different from the specific ink.

11. The inkjet recording apparatus as defined in claim 2, further comprising a print halt device which halts a printing operation in the inkjet recording apparatus when the determining device determines that the inkjet recording ink is different from the specific ink.

12. An ink determination method, comprising the steps of:

illuminating an inkjet recording ink with light, the inkjet recording ink being filled in at least one of an ink supply tank made at least partially of a transparent material, and a line between an ink supply tank and an inkjet head;

measuring, in a plurality of different wavelengths, luminous energy of one of the light transmitted through the inkjet recording ink and the light reflected by the inkjet recording ink, for the inkjet recording ink of one color;

obtaining a ratio or difference of the measured luminous energy in the plurality of different wavelengths;

making a comparison between the obtained ratio or difference of the luminous energy in the plurality of different wavelengths, and a ratio or difference of luminous energy, in the plurality of different wavelengths, for one of the light transmitted through an ink having a first composition, and light reflected by the ink having the first composition; and determining whether the inkjet recording ink is the ink having the first composition, or whether the inkjet recording ink has a second composition different from the first composition and has a color similar to the ink having the first composition according to a result of the comparison.

* * * * *